US008887704B2

(12) United States Patent
Spix et al.

(10) Patent No.: US 8,887,704 B2
(45) Date of Patent: Nov. 18, 2014

(54) ENGINE ASSEMBLY WITH ENGINE BLOCK-MOUNTED AIR-OIL SEPARATOR AND METHOD OF VENTILATING AN ENGINE CRANKCASE

(75) Inventors: Thomas A. Spix, Rochester Hills, MI (US); Michael B. Fleck, Oakland Township, MI (US); Kenneth James Patton, Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 289 days.

(21) Appl. No.: 13/448,506

(22) Filed: Apr. 17, 2012

(65) Prior Publication Data

US 2013/0269636 A1 Oct. 17, 2013

(51) Int. Cl.
*F02M 25/00* (2006.01)

(52) U.S. Cl.
USPC ..... 123/572

(58) Field of Classification Search
USPC ..... 123/572–574, 41.86, 54.4–54.8
See application file for complete search history.

(56) References Cited

U.S. PATENT DOCUMENTS

| | | | | |
|---|---|---|---|---|
| 4,528,969 | A * | 7/1985 | Senga | 123/572 |
| 5,617,834 | A * | 4/1997 | Lohr | 123/572 |
| 6,142,129 | A * | 11/2000 | Hori et al. | 123/572 |
| 6,234,154 | B1 * | 5/2001 | Spix | 123/572 |
| 6,460,525 | B1 * | 10/2002 | Shureb | 123/572 |
| 7,047,955 | B2 * | 5/2006 | Ookawa et al. | 123/572 |
| 8,047,186 | B2 * | 11/2011 | Shieh et al. | 123/572 |
| 2002/0046743 | A1 * | 4/2002 | Moren | 123/572 |
| 2009/0241921 | A1 * | 10/2009 | Ito et al. | 123/573 |
| 2010/0126479 | A1 * | 5/2010 | Shieh et al. | 123/573 |
| 2010/0269803 | A1 * | 10/2010 | Iwata | 123/572 |
| 2011/0290225 | A1 * | 12/2011 | Torella | 123/573 |

* cited by examiner

*Primary Examiner* — M. McMahon
(74) *Attorney, Agent, or Firm* — Quinn Law Group, PLLC

(57) ABSTRACT

An engine assembly includes an engine block at least partially defining a combustion chamber and a crankcase volume. The engine block defines an opening in fluid communication with the crankcase volume. An air-oil separator is mounted to the engine block at the opening and is configured to separate oil from blowby gasses flowing from the crankcase volume through the air-oil separator. A method of venting an engine crankcase volume is also included.

11 Claims, 4 Drawing Sheets

ENGINE ASSEMBLY WITH ENGINE BLOCK-MOUNTED AIR-OIL SEPARATOR AND METHOD OF VENTILATING AN ENGINE CRANKCASE

TECHNICAL FIELD

The present teachings generally include an engine assembly having an air-oil separator.

BACKGROUND

Blowby gasses are combustion gasses that leak from an engine cylinder past piston rings into the crankcase volume. To prevent the blowby gasses from exiting to the atmosphere, positive crankcase ventilation (PCV) systems transfer blowby gasses from an engine crankcase volume to the engine air intake system, where the blowby gasses are mixed with fresh air and are combusted in the engine cylinders. The blowby gasses include unburned fuel, combustion byproducts, and water vapor. The blowby gasses mix with oil mist in the crankcase. Air-oil separators are sometimes used in the PCV system to separate oil from the blowby gasses en route to the air intake system. The air-oil separators are typically mounted within the cylinder head cover which in turn is mounted to the cylinder head and engine block. This increases the overall packaging space required for the engine assembly. In addition, the water vapor in blowby gasses can freeze within the vent system passages at low operating temperatures, such as below freezing.

SUMMARY

An engine assembly includes an engine block at least partially defining a combustion chamber and a crankcase volume. The engine block defines an opening in fluid communication with the crankcase volume. An air-oil separator is mounted to the engine block at the opening and is configured to separate oil from blowby gasses flowing from the crankcase volume through the air-oil separator.

In one aspect of the present teachings, the air-oil separator is a first air-oil separator, and the engine assembly includes a cylinder head mounted to the engine block and an air intake system operatively connected to the cylinder head. A second air-oil separator is in fluid communication with the air intake system. The engine block defines a passage that at least partially establishes fluid communication between the first air-oil separator and the second air-oil separator such that oil is first separated from the blowby gasses by the first air-oil separator and is further separated from the blowby gasses by the second air-oil separator.

A method of ventilating an engine crankcase volume includes directing blowby gasses from the crankcase volume through a first air-oil separator mounted in the engine block adjacent the crankcase volume to separate oil from the blowby gasses. The blowby gasses passing through the first air-oil separator are then heated by directing engine cooling fluid through a coolant passage in the engine block.

The above features and advantages and other features and advantages of the present teachings are readily apparent from the following detailed description of the best modes for carrying out the present teachings when taken in connection with the accompanying drawings.

DETAILED DESCRIPTION

Figure 1:
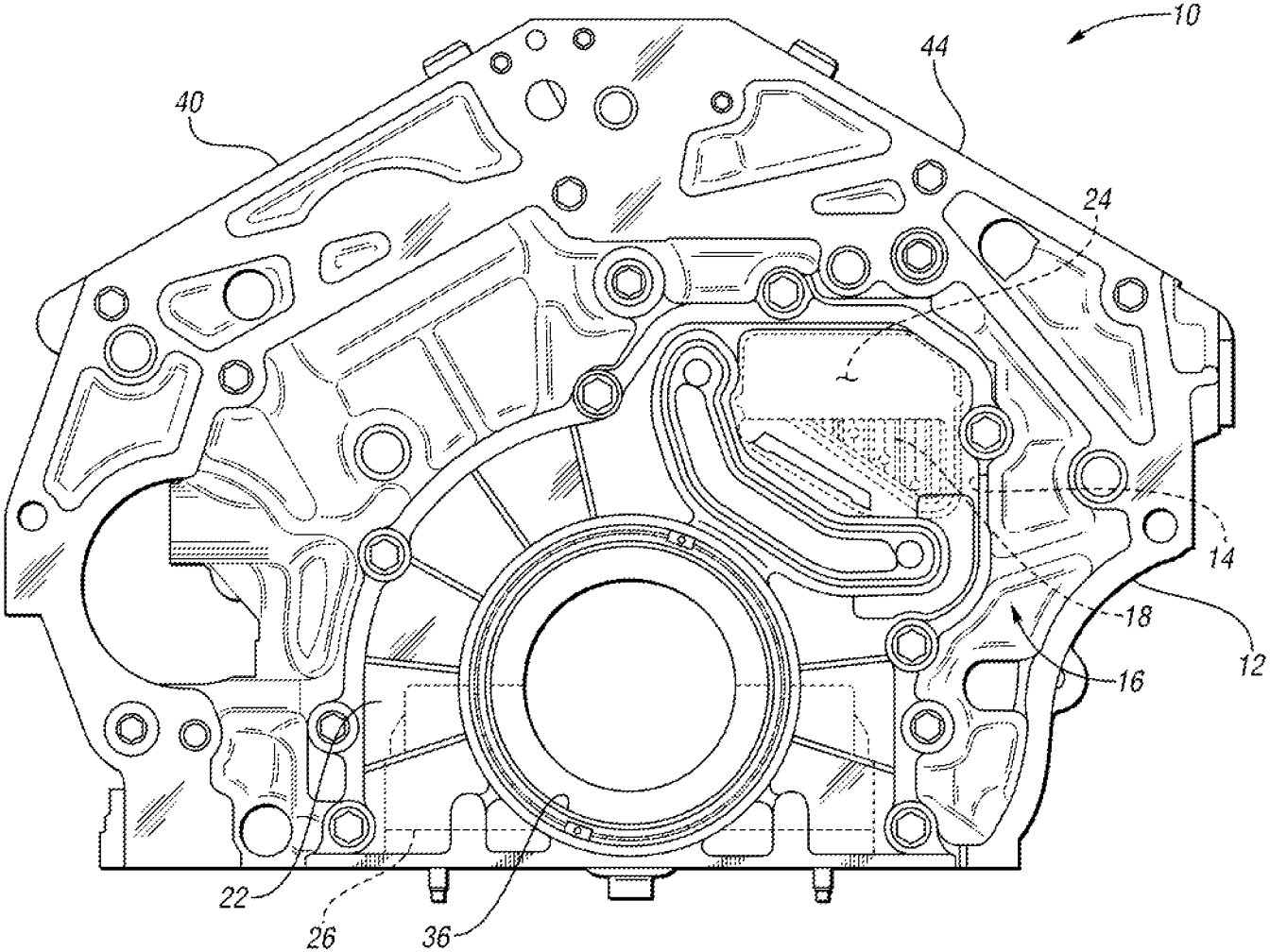
FIG. 1 is a schematic rear view illustration of an engine assembly that includes a positive crankcase ventilation system with an air-oil separator mounted in the engine block and covered by a rear seal cover assembly.

Referring to the drawings, wherein like reference numbers refer to like components throughout the several views, FIG. 1 shows a portion of an engine assembly 10. The engine assembly 10 includes an engine block 12 that may be a cast aluminum alloy or other appropriate material. The engine block 12 has an opening 14 at a rear face 16 of the engine block 12. An air-oil separator 18 is mounted to the engine block 12 at the opening 14 and serves to separate oil from blowby gasses vented from a crankcase volume 28 in the engine block 12, as further explained herein. A rear seal cover assembly 22 is fastened to the engine block 12 and encloses a rear side 24 of the air-oil separator 18.

Figure 2:
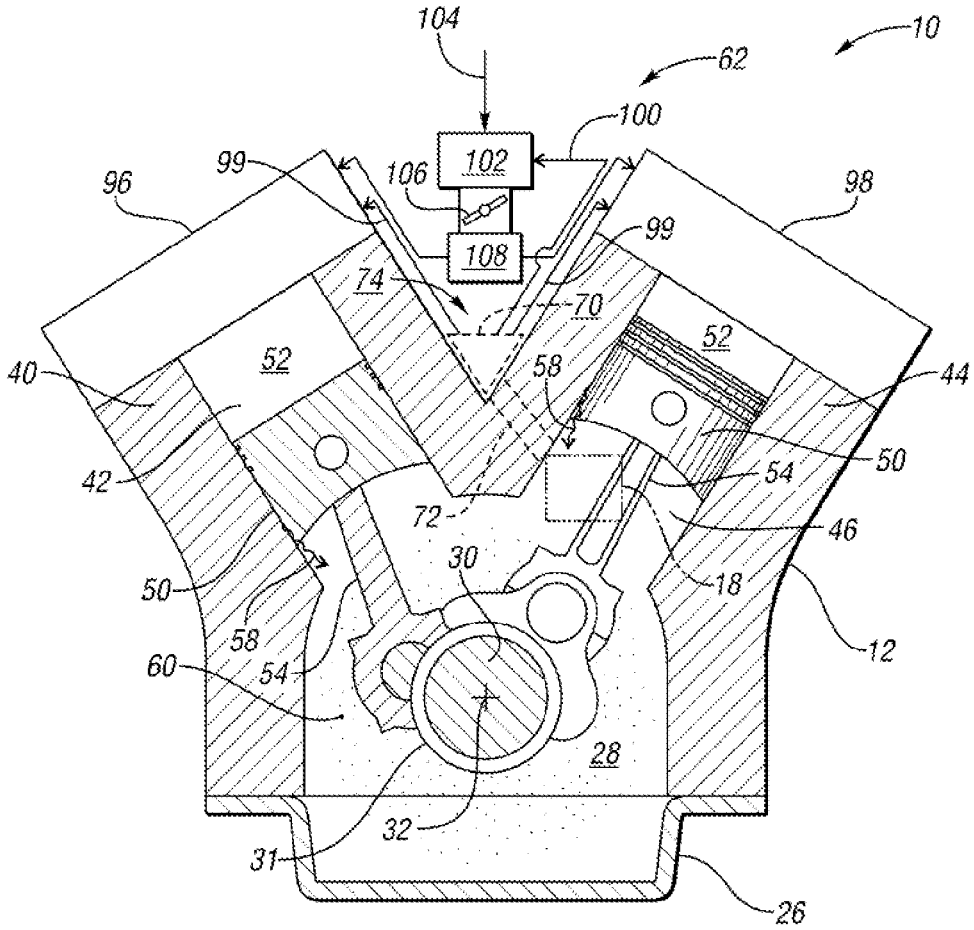
FIG. 2 is a schematic cross-sectional illustration of the engine assembly and positive crankcase ventilation system of FIG. 1 taken at lines 2-2 in FIG. 4.
Figure 3:
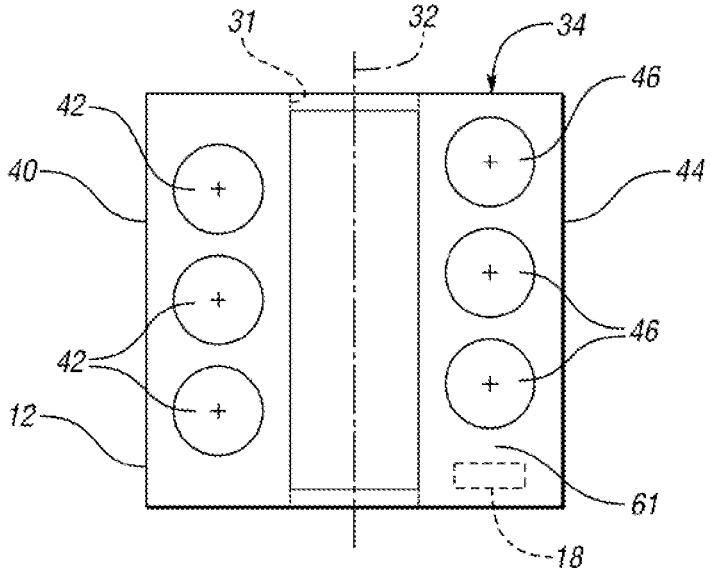
FIG. 3 is a schematic illustration in plan view of the engine block of FIG. 1.
Figure 4:
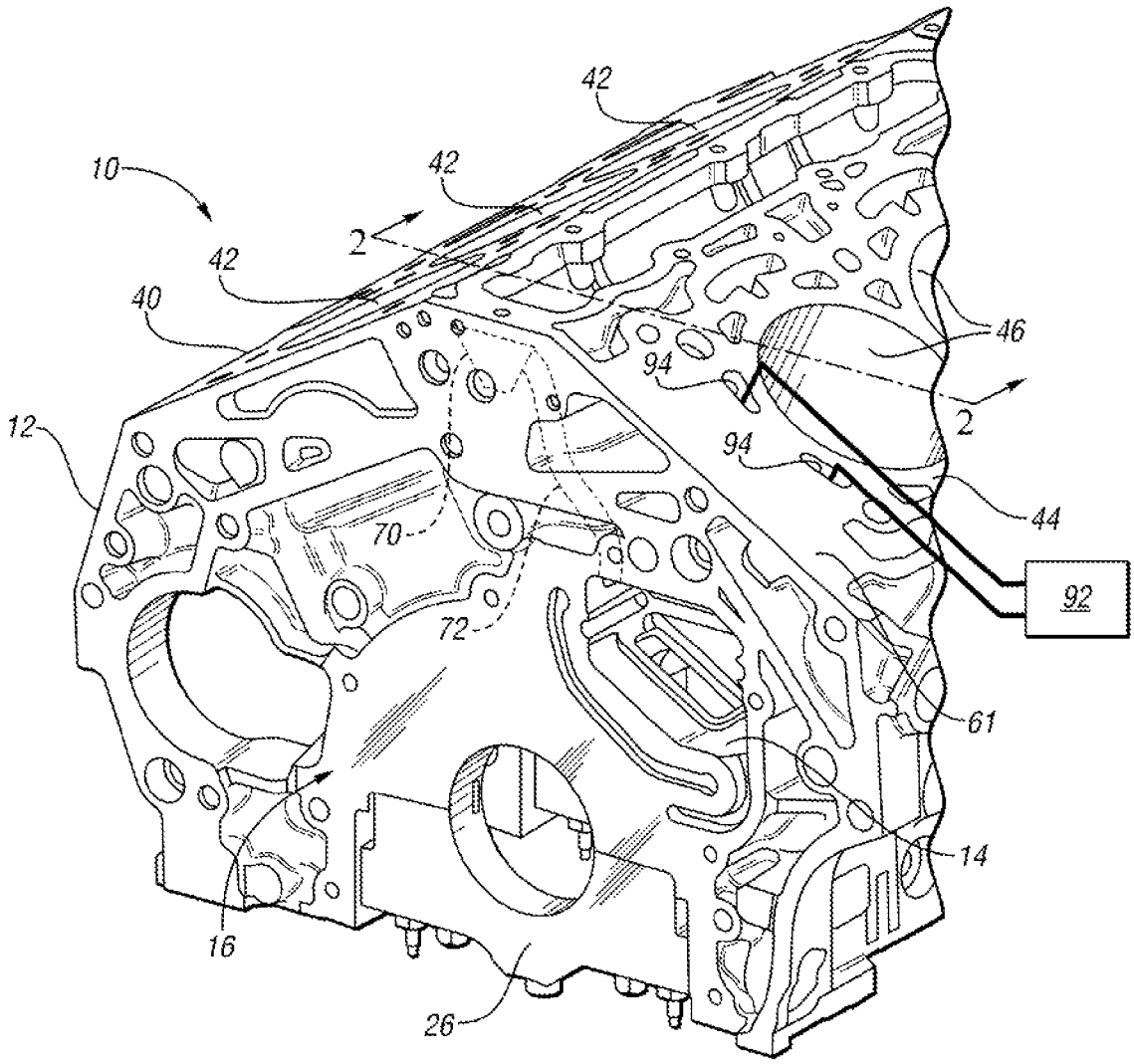
FIG. 4 is a schematic perspective illustration in fragmentary view of the engine block of FIGS. 1-3 with the air-oil separator removed.

FIG. 2 is a schematic representation of the engine block 12 taken at lines 2-2 in FIG. 4. The engine block 12 has an oil pan 26 connected to a lower portion of the engine block 12. The engine block 12 and the oil pan 26 together define an interior cavity referred to as a crankcase volume 28. A crankshaft 30 extends through the engine block 12 in the crankcase volume 28, defining an axis of rotation 32. The crankshaft 30 extends through an opening 31 in a front face 34 of the engine block 12 and through an opening 36 in the rear seal cover assembly 22 shown in FIG. 1. The engine block 12 is configured in a V-formation, with a first bank 40 of cylinder bores 42 and a second bank 44 of cylinder bores 46 shown in FIG. 3. The cylinder bores 42 and 46 come together in a V formation at the crankcase volume 28. Pistons 50 in the cylinder bores 42, 46 separate combustion chambers 52 from the crankcase volume 28 as shown in FIG. 2. Connecting rods 54 connect the pistons 50 to the crankshaft 30.

Blowby gasses 58 can leak past the pistons 50 into the crankcase volume 28. Blowby gasses include uncombusted fuel, products of combustion including water, and air. The blowby gasses 58 mix with oil droplets 60 from lubricating oil that drains to the oil pan 26. It is desirable to route the blowby gasses 58 back to the combustion chambers 52 for combustion. This is done with a positive crankcase ventilation (PCV) system 62 shown in part in FIG. 2. The oil droplets 60 must be separated from the blowby gasses 58 prior to delivery to the combustion chambers 52. The PCV system 62 includes the air-oil separator 18, which is shown in phantom in FIG. 2 as it is in the opening 14 of FIG. 4 and therefore not visible in the cross-section of FIG. 2. The air-oil separator 18 is positioned in the opening 14 in the block 12 at one end of the second bank 44. As best shown in FIG. 3, the bores 42 are axially offset from the bores 46 in a direction along the axis of rotation 32. This creates a portion of the second bank 44 referred to as the bank offset 61. The bank offset 61 is opposite the rearmost bore 42 of the first bank 40.

FIG. 2 shows that the PCV system 62 also includes a main air-oil separator 70 that is in fluid communication with the air-oil separator 18 by a passage 72 through the engine block 12 from the opening 14 to the main air-oil separator 70. The main air-oil separator 70 is in a valley 74 defined between the cylinder banks 40, 44. The air-oil separator 18 is referred to as a first air-oil separator, or pre-separator, and the air-oil separator 70 is referred to as a second or main air-oil separator. The first air-oil separator 18 can be referred to as a primary air-oil separator and the second air-oil separator 70 can be referred to as a secondary air-oil separator.

Figure 5:
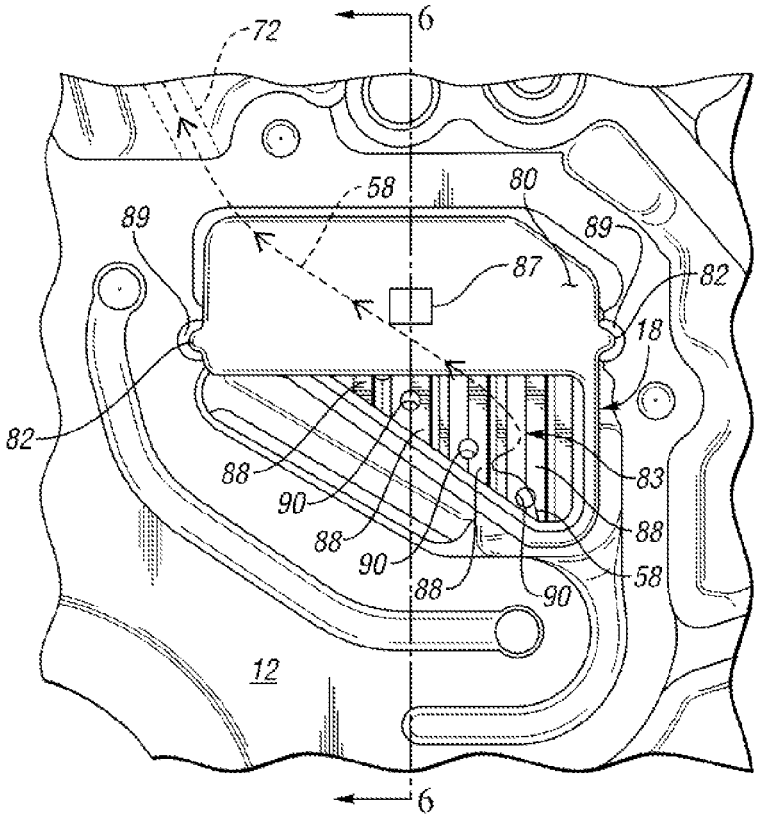
FIG. 5 is a schematic illustration in fragmentary rear view of the air-oil separator mounted to the engine block with the rear seal cover assembly removed.
Figure 6:
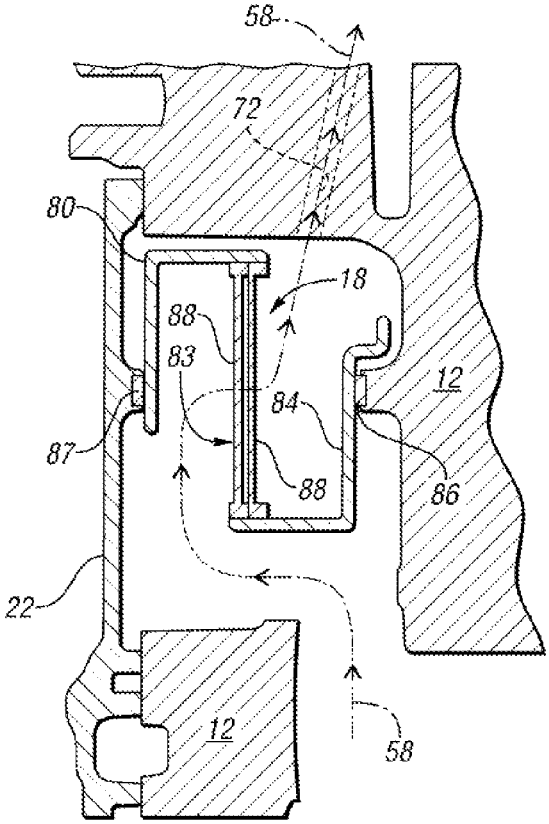
FIG. 6 is a schematic illustration in fragmentary cross-sectional view taken at the lines 6-6 in FIG. 5.

The air-oil separator 18 is designed to remove large oil droplets 60 before the blowby gasses 58 enter the main air-oil separator 70, thereby reducing oil consumption. As shown in FIGS. 5 and 6, the air-oil separator 18 includes a first flange 80 with one or more tabs 82 that snap to complementary retaining cavities 89 in the engine block 12. A retaining component 87 of relatively soft material is attached to the first flange 80 and fits into a recess in the rear seal cover assembly 22 or rests against the rear seal cover 22 to help prevent movement of the first flange 80. The air-oil separator 18 could also be connected to the engine block 12 and the rear seal cover assembly 22 in any other suitable manner. The air-oil separator 18 also includes a second flange 84 with a similar retaining component 86 of relatively soft material and positioned in a recess in the engine block 12, as well as similar tabs (not visible in FIG. 6) that fit to cavities in the engine block 12. An oil separator mechanism in the form of V-shaped strips 88 is supported between the flanges 80, 84.

In this embodiment, the air-oil separator 18 is a series of vertically-extending, spaced, V-shaped strips 88 arranged offset from one another in at least two rows to create a tortuous flow path through the air-oil separator 18 from the crankcase volume 28 to the passage 72. While the blowby gasses 58 tend to pass through the rows, a large fraction of the oil droplets 60 contact the V-shaped strips and tend to drain downward via gravity along an outer surface 83 of the strips facing the crankcase volume 28. The V-shaped strips 88 may have openings 90 that allow blowby gasses 58 to pass directly through the strips 88 to prevent excessive back pressure in the PCV system 62. The main air-oil separator 70 may be a similar configuration. In other embodiments, the air-oil separators 18, 70 can be a fleece material or other porous material that permits gas flow and tends to prevent the passage of the oil droplets 60. Other configurations of an air-oil separator that allows oil to collect can also be used.

The engine assembly 10 includes a cooling system 92, shown schematically in FIG. 4, that is operatively connected to water jacket passages 94 in the engine block 12. The cooling system 92 is a closed circuit of coolant, pressurized by a pump (not shown), to transfer heat from the engine block 12, as is known. The passages 94 and other cooling system passages are in the vicinity of the bank offset 61. The heat transferred through the coolant in the passages 94 tends to warm engine block 12 in the area of the crankcase volume 28 near the bank offset 61. This tends to bring the temperature of the blowby gasses 58 in the crankcase volume 28 close to the temperature of the coolant, helping to minimize or delay any freezing of water vapor in the air carried through the PCV system 62.

Referring again to FIG. 2, the PCV system 62 routes some of the blowby gasses 58 that pass through the main air-oil separator 70 to a first cylinder head 96 and a second cylinder head 98 on the first and second banks 40, 44, respectively, through conduits 99 that may be in the cylinder block 12. Alternatively or in addition, a portion of the blowby gasses 58 that have passed the main air-oil separator 70 is routed along conduit 100 to an air cleaning system 102, where it is mixed with fresh air 104. The intake air mixture then passes a throttle 106 to an intake manifold 108 where it is routed to the cylinder heads 96, 98.

Accordingly, a method of ventilating the engine crankcase volume 28 includes directing blowby gasses 58 from the crankcase volume 28 through a first air-oil separator 18 mounted in the engine block 12 adjacent the crankcase volume 28 to separate oil from the blowby gasses 58. Furthermore, the blowby gasses 58 passing through the first air-oil separator 18 are heated by directing engine cooling fluid through one or more coolant passages 94 in the engine block 12. Additionally, the method includes directing the blowby gasses 58 from the first air-oil separator 18 to a second air-oil separator 70 through a connecting passage 72 that at least partially establishes fluid communication between the first air-oil separator 18 and the second air-oil separator 70 such that oil is further separated from the blowby gasses 58 by the second air-oil separator 70.

While the best modes for carrying out the many aspects of the present teachings have been described in detail, those familiar with the art to which these teachings relate will recognize various alternative aspects for practicing the present teachings that are within the scope of the appended claims.

The invention claimed is:

1. An engine assembly comprising:

an engine block at least partially defining a combustion chamber and a crankcase volume; wherein the engine block defines an opening in fluid communication with the crankcase volume;

a first air-oil separator mounted to the engine block at the opening and configured to separate oil from blowby gasses flowing through the first air-oil separator from the crankcase volume;

a cylinder head mounted to the engine block;

an air intake system operatively connected to the cylinder head;

a second air-oil separator in fluid communication with the air intake system;

wherein the engine block defines a passage that at least partially establishes fluid communication between the first air-oil separator and the second air-oil separator such that oil is first separated from the blowby gasses by the first air-oil separator and is further separated from the blowby gasses by the second air-oil separator;

wherein the engine block is configured to support a rotatable crankshaft extending through the crankcase volume; wherein the engine block defines cylinder bores arranged in a first bank and in a second bank in a substantially V-shaped formation about the crankshaft; wherein the cylinder bores of the first bank are axially offset from the cylinder bores of the second bank along an axis of rotation of the crankshaft; and wherein the second air-oil separator is positioned between the banks of cylinder bores in a valley defined by the banks of cylinder bores.

2. The engine assembly of claim 1, wherein the first air-oil separator is positioned at an end of the first bank.

3. The engine assembly of claim 2, further comprising a rear seal cover assembly configured to operatively connect to the engine block such that the first air-oil separator is substantially enclosed between the rear seal cover assembly and the crankcase volume.

4. The engine assembly of claim 1, wherein the first air-oil separator is positioned substantially vertically to promote drainage of oil down a surface of the first air-oil separator facing the crankcase volume.

5. The engine assembly of claim 1, wherein the engine block defines a passage; wherein the engine assembly further comprises:

a cooling system that includes coolant directed through the passage; and wherein heat from the coolant is transferred through the engine block to the adjacent first air-oil separator.

6. The engine assembly of claim 1, wherein the first air-oil separator includes a series of substantially vertical strips creating a tortuous flow path through the first air-oil separator.

7. An engine assembly comprising:

an engine block at least partially defining a combustion chamber and a crankcase volume; wherein the engine block defines cylinder bores arranged in a first bank and in a second bank in a substantially V-shaped formation; wherein the cylinder bores of the first bank are axially offset from the cylinder bores of the second bank along an axis of rotation of a crankshaft extending through the crankcase volume; wherein the engine block defines an opening in fluid communication with the crankcase volume;

a first air-oil separator mounted to the engine block at the opening and configured to separate oil from blowby gasses flowing from the crankcase volume; wherein the first air-oil separator is positioned substantially vertically to promote drainage of oil down a surface of the first air-oil separator facing the crankcase volume;

a cylinder head mounted to the engine block;

an air intake system operatively connected to the cylinder head; wherein the air intake system includes an air cleaning system;

a second air-oil separator in fluid communication with the air intake system; and wherein the engine block defines a passage that at least partially establishes fluid communication between the first air-oil separator and the second air-oil separator such that oil is first separated from the blowby gasses by the first air-oil separator and is further separated from the blowby gasses by the second air-oil separator;

wherein the second air-oil separator is positioned between the banks of cylinder bores in a valley defined by the banks of cylinder bores;

a conduit that establishes fluid communication between the second air-oil separator and the air cleaning system such that at least some of the blowby gasses that have passed through the second air-oil separator are directed to the air cleaning system via the conduit.

8. The engine assembly of claim 7, wherein the engine block defines a cooling passage; and wherein the engine assembly further comprises:

a cooling system that includes coolant directed through the cooling passage; and wherein heat from the coolant is transferred through the engine block to the first air-oil separator.

9. The engine assembly of claim 7, further comprising:

a rear seal cover assembly configured to operatively connect to the engine block such that the rear seal cover assembly substantially encloses a side of the first air-oil separator opposite the crankcase volume.

10. A method of ventilating an engine crankcase volume comprising:

positioning a first air-oil separator in an engine block adjacent the crankcase volume;

positioning a second air-oil separator between banks of cylinder bores in a valley defined by the banks of cylinder bores in the engine block; wherein the banks of cylinder bores are arranged in a substantially V-shaped formation about an engine crankshaft supported by the engine block;

directing blowby gasses from the crankcase volume through the first air-oil separator mounted in the engine block adjacent the crankcase volume to separate oil from the blowby gasses;

directing the blowby gasses from the first air-oil separator to the second air-oil separator through a connecting passage that at least partially establishes fluid communication between the first air-oil separator and the second air-oil separator such that oil is further separated from the blowby gasses by the second air-oil separator; and heating the blowby gasses passing through the first air-oil separator by directing engine cooling fluid through a coolant passage in the engine block.

11. The method of claim 10, further comprising:

directing the blowby gasses from the second air-oil separator to a combustion chamber within the engine block; and combusting at least some of the blowby gasses.

* * * * *